US008152480B1

(12) United States Patent
Thelen et al.

(10) Patent No.: US 8,152,480 B1
(45) Date of Patent: Apr. 10, 2012

(54) VEHICLE MOUNTED WATER PUMP ASSEMBLY FOR PUMPING OUT WATER FILLED DEPRESSIONS IN THE GROUND

(75) Inventors: Joseph P. Thelen, Shakopee, MN (US); Andrew J. Kjolhaug, Rosemount, MN (US); Cal N. Kosieracki, St. Louis Park, MN (US)

(73) Assignee: The Toro Company, Bloomington, MN (US)

( * ) Notice: Subject to any disclaimer, the term of this patent is extended or adjusted under 35 U.S.C. 154(b) by 655 days.

(21) Appl. No.: 12/363,280

(22) Filed: Jan. 30, 2009

(51) Int. Cl.
*F04B 53/00* (2006.01)
*F01B 23/08* (2006.01)
*A47G 29/00* (2006.01)

(52) U.S. Cl. ..... 417/234; 417/375; 417/235; 417/321; 248/81; 248/80; 248/75

(58) Field of Classification Search ..... None
See application file for complete search history.

(56) References Cited

U.S. PATENT DOCUMENTS

| | | | |
|---|---|---|---|
| 755,995 | A | 3/1904 | Brown |
| 2,698,583 | A | 1/1955 | House et al. |
| 3,047,236 | A | 7/1962 | Fahrner |
| 3,779,670 | A | 12/1973 | Crisafulli |
| 3,966,361 | A | 6/1976 | House |
| 5,526,982 | A | 6/1996 | McKenzie |
| 2008/0166244 | A1 | 7/2008 | Winge |

*Primary Examiner* — Natalie Walford
(74) *Attorney, Agent, or Firm* — James W. Miller

(57) ABSTRACT

A water pump assembly includes a frame having a mount for mounting the frame to a vehicle. A water pump is mounted within a bottom bowl on the frame and is substantially surround by an encircling U-shaped foot to protect the water pump from damage. A pivotal arch is carried on the frame and a water discharge nozzle is carried on the arch. A flexible conduit connects the nozzle to an outlet of the water pump. Pivoting of the arch flexes the conduit in a fore and aft direction to raise or lower the trajectory of the water stream being thrown from the nozzle. In addition, pivoting of the nozzle about a vertical axis on the arch laterally changes the direction of throw of the water stream by flexing or twisting the conduit in a side to side manner. The nozzle is carried on the arch using a nozzle support sleeve in which the nozzle is free to slide back and forth to accommodate changes in the orientation of the conduit.

20 Claims, 12 Drawing Sheets

VEHICLE MOUNTED WATER PUMP ASSEMBLY FOR PUMPING OUT WATER FILLED DEPRESSIONS IN THE GROUND

TECHNICAL FIELD

This invention relates to a water pump assembly that may be mounted on an outdoor turf maintenance vehicle or similar vehicle. When so mounted, the vehicle may be used to position the pump assembly at least partially within a swale or depression in the ground, such as a sand trap or bunker on a golf course, to pump out any water that may have collected in the depression.

BACKGROUND OF THE INVENTION

Various vehicle mounted water pump assemblies have been proposed for pumping out water filled depressions in the ground. Such depressions can include work sites, ditches, excavations, and the like that must be cleared of water before work on a construction project can continue. However, such depressions also typically include sand traps or bunkers on a golf course that may become filled with water from a heavy rain. It is desirable to pump out such sand traps or bunkers, rather than wait for them to drain or dry naturally, in order to return the golf course to a playable condition as soon as possible.

US Patent Publication 2008/0166244 to Winge depicts one such water pump assembly. Winge discloses using a directional nozzle coupled to the water pump to be able to direct where the water stream being pumped by the nozzle lands. However, Winge discloses using an oscillating, impact type sprinkler as the nozzle and thus provides a relatively complicated and more expensive solution to the problem of directional control of the nozzle. It would be an advance in the art to provide a way of easily and quickly adjusting the trajectory of the water stream being thrown using a simple, durable and inexpensive adjustment mechanism for the nozzle In addition, Winge mounts the water pump to the vehicle in a manner in which the water pump is basically exposed to impacts should the vehicle be backed up or driven forwardly and the water pump were to strike an obstacle. It would be extremely easy to damage the water pump in Winge if the operator of the vehicle were not careful when trying to position the water pump using the motion of the vehicle. Damaging the water pump means the water pump has to be repaired or replaced. This is obviously both expensive and time consuming.

Finally, the water being pumped out of a sand trap or bunker will often be heavily laden with suspended particles of sand or grit. This is particularly as true the water level lowers and the inlet to the pump approaches the bottom of the sand trap or bunker. Pumping this water through an oscillating impact type sprinkler is not desirable as the sand or grit may quickly contaminate and foul the operation of the sprinkler. This again will require that the sprinkler be repaired or replaced.

Accordingly, a water pump assembly in which the water pump is well protected against damage from impacts and in which the operation of the nozzle is not sensitive to the presence of sand or grit in the water stream would be a further advance in the art.

SUMMARY OF THE INVENTION

One aspect of this invention relates to a water pump assembly adapted to be installed on a vehicle for pumping water out of water filled depressions in the ground. The water pump assembly comprises a frame having a mount for mounting the frame to the vehicle. A water pump is mounted on the frame and is surrounded by an encircling U-shaped foot on the frame to protect the water pump from damage from impacts with obstacles. A pivotal member is carried on the frame for pivoting motion about a substantially horizontal pivot axis. A water discharge nozzle is carried on the pivotal member. A flexible conduit connects the water discharge nozzle on the pivotal member to an outlet of the water pump on the frame. Pivoting of the pivotal member on the frame about the substantially horizontal pivot axis flexes the conduit in a fore and aft direction to raise or lower the trajectory of the water stream being thrown from the nozzle.

Another aspect of this invention relates to a water pump assembly adapted to be installed on a vehicle for pumping water out of water filled depressions in the ground. The water pump assembly comprises a frame having a mount for mounting the frame to the vehicle. A water pump is mounted on the frame. A pivotal member is carried on the frame for pivoting motion about a substantially horizontal pivot axis. A water discharge nozzle is carried on the pivotal member with the nozzle receiving water being pumped by the pump for throwing the water being pumped by the pump in a water stream along a trajectory relative to horizontal. The trajectory of the water stream being thrown by the nozzle is adjustable by pivoting of the pivotal member on the frame about the substantially horizontal pivot axis. A nozzle support sleeve mounts the nozzle on the pivotal member. The nozzle is telescopically received inside the nozzle support sleeve and slides back and forth within the nozzle support sleeve as the trajectory of the water stream is adjusted by pivoting of the pivotal member.

Yet another aspect of this invention relates to a water pump assembly adapted to be installed on a vehicle for pumping water out of water filled depressions in the ground. The water pump assembly comprises a frame having a mount for mounting the frame to the vehicle. A water pump is mounted on the frame. A pivotal member is carried on the frame for pivoting motion about a substantially horizontal pivot axis. A water discharge nozzle is carried on the pivotal member. A flexible conduit connects the water discharge nozzle on the pivotal member to an outlet of the water pump on the frame. Pivoting of the pivotal member on the frame about the substantially horizontal pivot axis flexes the conduit in a fore and aft direction to raise or lower the trajectory of the water stream being thrown from the nozzle. The pump mounts on the frame using a keeper that engages the pump and restrains vertical movement of one side of the pump when the pump is abutted against a floor of the frame and the pump has been moved to engage the one side of the pump against the keeper. The pump also mounts on the frame using a pivotal wire form that pivots over an opposite side of the pump and engages against a portion of the pump to clamp the opposite side of the pump against the floor of the frame. The wire form is manually pivotal between a first clamping position in which the wire form overlies the opposite side of the pump and a second non-clamping position in which the wire form is clear of the opposite side of the pump to allow the pump to be quickly and easily installed on or removed from the floor of the frame.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Introduction

Figure 1:
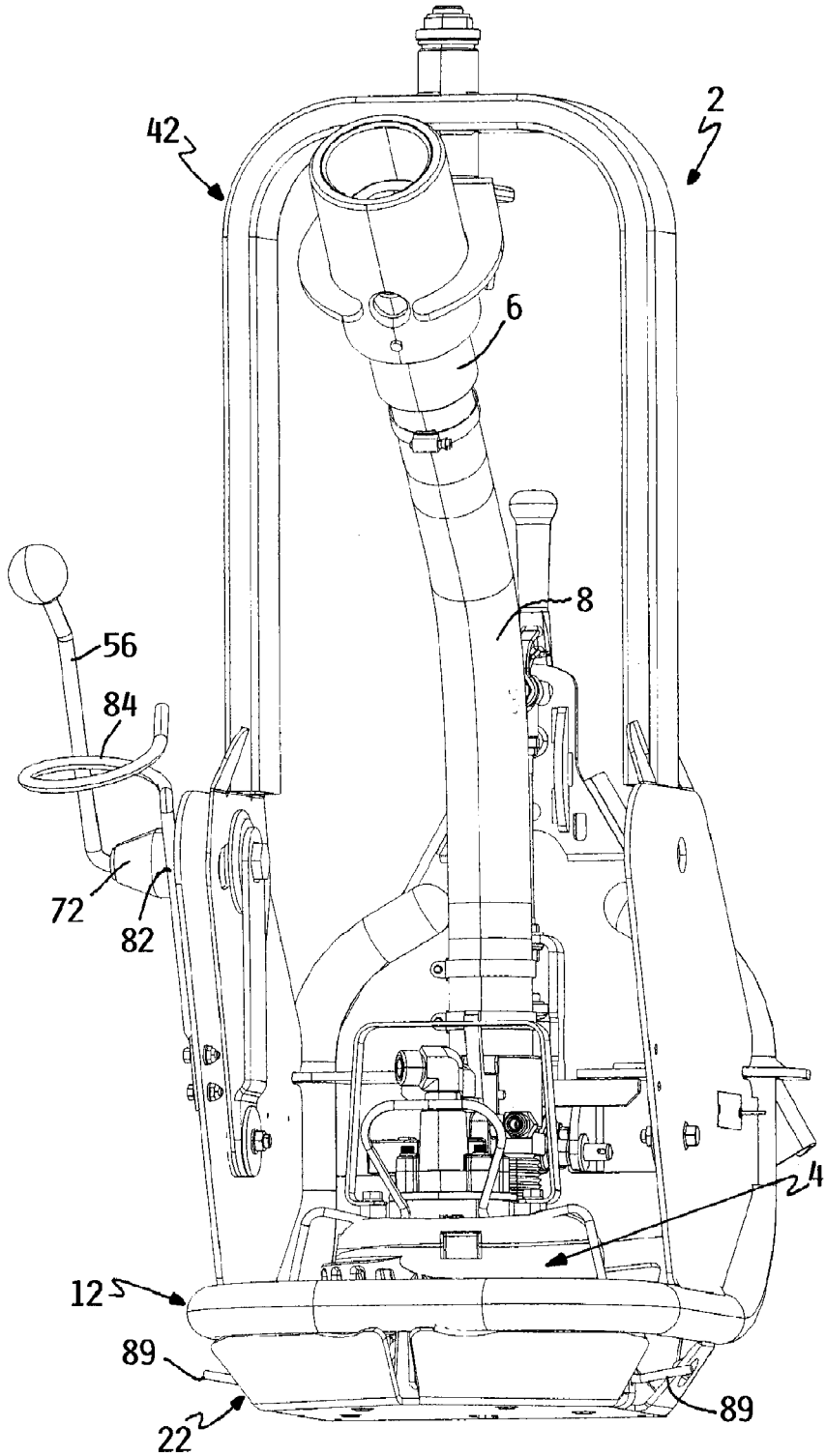
FIG. 1 is a perspective view of a water pump assembly according to this invention, particularly illustrating the water discharge nozzle having been adjusted to throw water along a first trajectory and in a first direction relative to the frame of the pump assembly.
Figure 2:
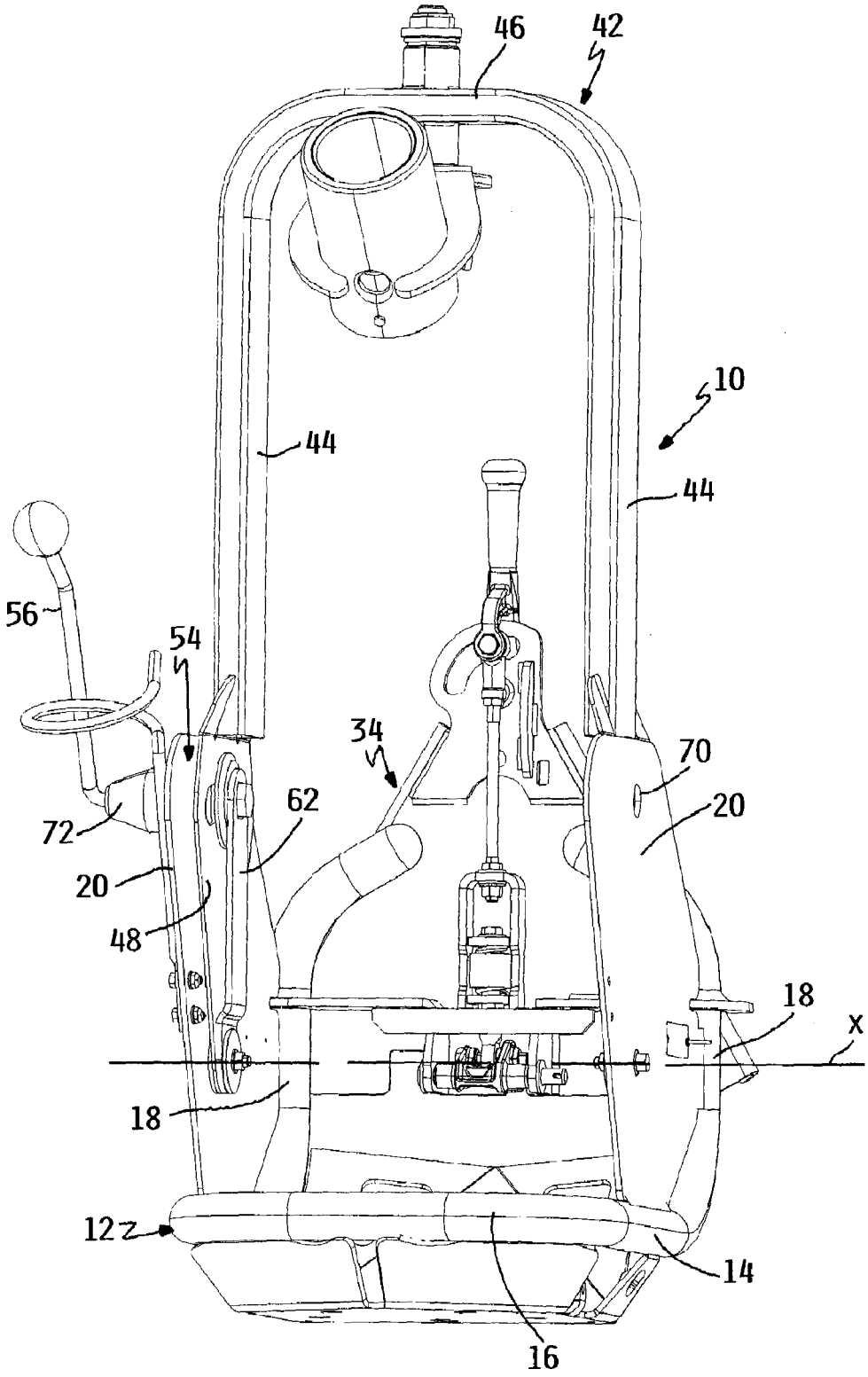
FIG. 2 is a perspective view of the pump assembly of FIG. 1, but with the water pump, the water discharge nozzle, and the flexible conduit that connects the outlet of the water pump to the water discharge nozzle having been removed for the purpose of clarity to better illustrate the frame of the pump assembly.

A water pump assembly according to this invention is illustrated generally as 2 herein. Pump assembly 2 is intended to be mounted on some type of turf maintenance vehicle (not shown), such as the Sand Pro line of sand trap grooming vehicles or the Workman line of utility vehicles that are manufactured and sold by The Toro Company, the assignee of this invention. When so mounted, the vehicle is used to position pump assembly 2 at least partially in a swale or depression in the ground that collects and retains water. This is done by driving the vehicle at least partially into the depression when pump assembly 2 is mounted on the front of the vehicle or by backing the vehicle at least partially into the depression when pump assembly 2 is mounted on the back of the vehicle. Preferably, as will be described hereafter, pump assembly 2 has a mount that allows pump assembly 2 to be interchangeably used on the front or the back of the vehicle.

The hydraulic system of the vehicle is also used to power a hydraulically operated water pump 4 that is part of pump assembly 2. After the vehicle has at least partially placed pump assembly 2 into the swale such that the inlet of pump 4 is in communication with the water in the depression, the hydraulic system of the vehicle can then place pump 4 into operation to begin pumping the water out of the depression. The water is thrown in a stream through a water discharge nozzle 6 that is operatively connected to the outlet of pump 4 by a flexible conduit 8.

Nozzle 6 can be elevated or lowered to throw the water along an adjustable trajectory. Nozzle 6 can also be turned from side to side to throw the water in different lateral directions relative to pump assembly 2, i.e. straight ahead, to the left, to the right, etc. The purpose of the adjustability of nozzle 6 is to allow the user to direct the water stream that is being pumped out of the depression to a desired location adjacent the depression. Typically, the depression being pumped out is often a sand trap or bunker on a golf course. The adjustability of nozzle 6 allows the water stream to be directed onto a fairway or rough that is adjacent to the sand trap or bunker.

As pump 4 operates and the water level in the depression lowers, the inlet of pump 4 will most likely become uncovered at some point. The operator can then simply further drive or back the vehicle into the depression to keep the pump inlet at or beneath the water level in the depression. If the mount that attaches pump assembly 2 to the vehicle is coupled to a lift and lower system on the vehicle, the operator also has the option of lowering pump assembly 2 relative to the vehicle as another way of keeping the inlet to pump 4 submerged. In any event, after a period of time and after repositioning pump assembly 2 as needed to keep the inlet to pump 4 in communication with the water in the depression, the depression will eventually be substantially pumped dry.

The advantage of using a vehicle mounted pump assembly 2 in the manner noted above is to facilitate and speed up various activities without waiting for the water filled depression to dry or drain naturally. For example, on a golf course, when the sand traps or bunkers become filled with water after a heavy rain, the course may be unplayable until the water in the sand traps or bunkers recedes. This time period can be greatly shortened simply by mounting pump assembly 2 on a suitable vehicle and by then driving such vehicle around to the sand traps or bunkers having standing water. A single operator can then place pump assembly 2 in such sand traps or bunkers and relatively quickly pump the water out of them. Thus, the golf course is returned to a playable condition much more quickly and any loss of revenue to the golf course owner is minimized. This is a desirable advantage of this type of vehicle mounted pump assembly.

The Frame of the Pump Assembly

A frame 10 of pump assembly 2 is best shown in FIGS. 2-6. Pump 4, conduit 8, and nozzle 6 have been removed from FIGS. 2-6 so as not to obstruct frame 10. Thus, the following description of frame 10 will be made primarily by referring to FIGS. 2-6.

Frame 10 includes a substantially horizontal, U-shaped foot 12 having a pair of laterally spaced side members 14 connected together by a front cross member 16. The rear ends of laterally spaced side members 14 are each connected to vertical, upwardly extending, rear legs 18. Rear legs 18 are also laterally spaced from one another, but the upper ends of rear legs 18 bend inwardly and point towards one another. The above described U-shaped foot 12 and rear legs 18 preferably form an integral, robust, tubular subframe.

Figure 4:
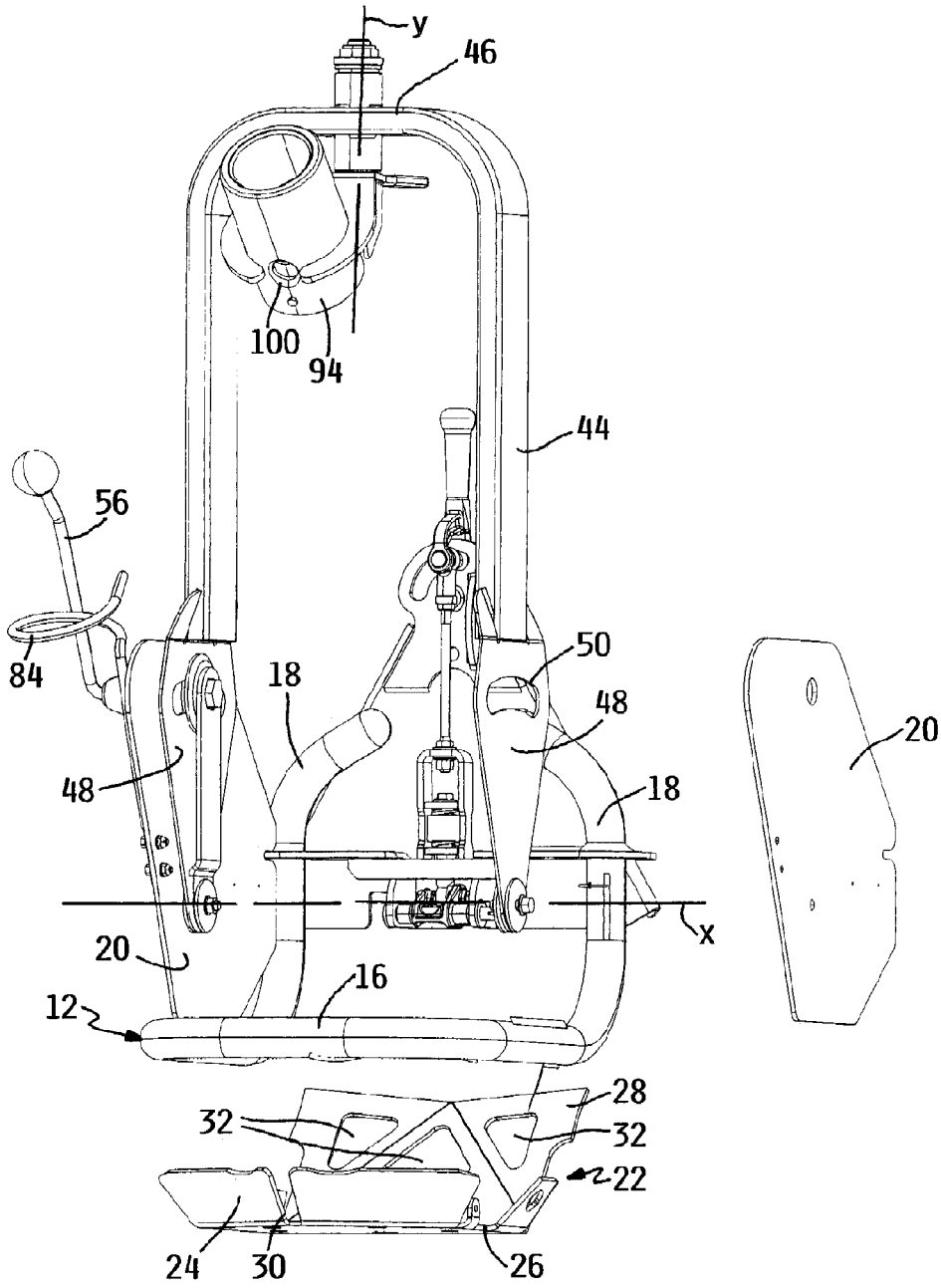
FIG. 4 is a perspective view similar to FIG. 2 of the frame of the pump assembly, but with one of the side plates and the bottom pump mounting bowl of the frame being shown in exploded form for the sake of clarity.

A pair of side plates 20 are fixedly secured, as by welding, to each side member 14 of foot 12 and to each rear leg 18. In addition, a bottom bowl 22 is also fixedly secured, again as by welding, to the bottom of U-shaped foot 12. As best shown in FIG. 4, bowl 22 includes a forwardly and upwardly inclined front wall 24, a substantially horizontal floor 26, and a rearwardly and upwardly inclined rear wall 28. Front wall 24 has a gap or opening 30 in the middle thereof, the sides of bowl 22 adjacent the sides of horizontal floor 26 are mostly open, and the rear wall of bowl 22, which is longer than the front wall of bowl 22, has an array of triangular shaped openings 32 therein. The various openings 30, 32 in bowl 22 are designed to promote water flow from the water filled depression into the interior of bowl 22 while simultaneously keeping out large pieces of debris from the interior of bowl 22. Since pump 4 is mounted atop floor 26 of bowl 22 such that pump 4 is substantially recessed down inside bowl 22, the openings 30, 32 disclosed in bowl 22 will help prevent large pieces of debris from contacting the inlet of pump 4 and from fouling pump 4.

A mount 34 is provided on the rear of frame 10 for coupling pump assembly 2 to a vehicle. One vehicle for which pump assembly 2 is designed is the Sand Pro line of sand trap grooming vehicles manufactured and sold by The Toro Company. Such Sand Pro vehicles have a portion of an A-frame mounting system, namely the male A-frame couplers (not shown herein), carried on both the front and rear of the vehicle. Various attachments are sold that carry the other half of the A-frame mounting system, namely the female couplers, to allow individual attachments to be releasably coupled to the Sand Pro vehicle at either the front or the rear by nesting the female A-frame coupler on the attachment over the male A-frame coupler on the appropriate end of the vehicle. This attachment system is known as the Quick Attachment System (QAS) for the Sand Pro line of vehicles.

Figure 3:
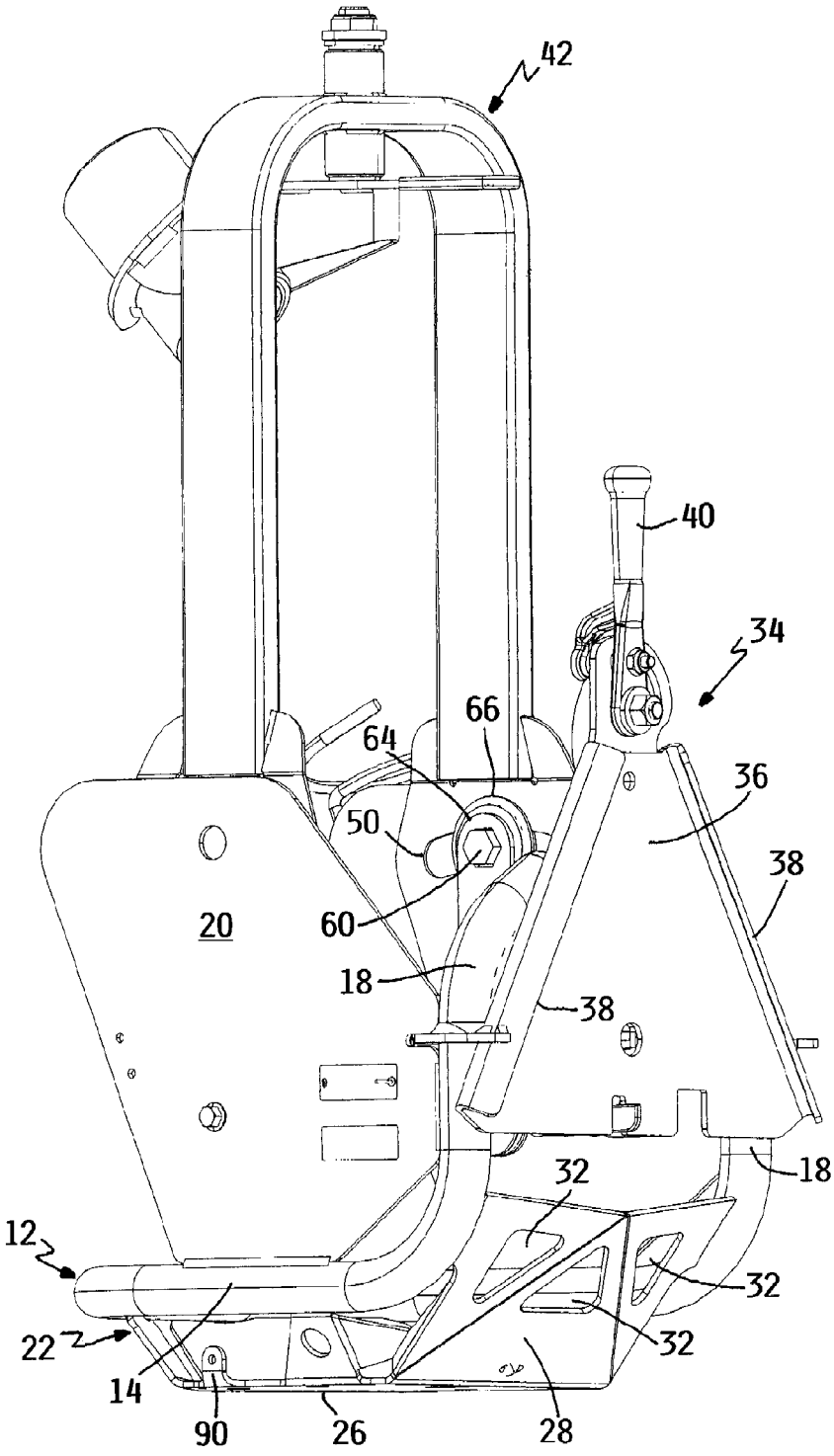
FIG. 3 is a perspective view of the frame of the pump assembly as depicted in FIG. 2, but taken from behind and towards the left of the pump assembly.

Mount 34 of pump assembly 2 of this invention is simply the female A-frame coupler 36 of Toro's existing QAS system located on the rear of frame 10. For example, FIG. 3 shows female A-frame coupler 36 having been fixedly secured to the back sides of rear legs 18 of frame 10. Note in FIG. 3 the A-frame shape to coupler 36 with the sides of coupler 36 tapering inwardly as they rise upwardly. Female coupler 36 has inwardly turned flanges 38 along each side that slide over and nest around portions of the male coupler on the vehicle when female coupler 36 is dropped down over the male coupler. This is how the connection between the vehicle and pump assembly 2 is preferably made. Female coupler 36 can include a lock operated by a handle 38 to latch the two couplers together after they are first nested on one another. The structure of the male and female couplers and the means for locking them together are well known in the QAS style attachments for the Sand Pro line of vehicles and form no part of this invention. While there must be some way of coupling pump assembly 2 to a vehicle, the precise type of coupling system can obviously vary.

Frame 10 of pump assembly 2 also includes a pivotal hoop or arch 42 carried thereon. Arch 42 is U-shaped and includes a pair of laterally spaced vertical posts 44 connected together at the top by an upper cross beam 46. Each post 44 also has a flattened flange 48 connected to the lower end thereof such that flange 48 and the attached post 44 are integrally fixed to one another. In effect, cross beam 46 forms the top of arch 42 and each side of arch 42 is formed by one of the posts 44 and the flange 48 that is integrally fixed thereto. Each flange 48 is pivotally secured to one side plate 20 on frame 10 such that the entire arch 42 pivots about a substantially horizontal pivot axis indicated as x in FIG. 4. The purpose of this pivoting motion will be to adjust the trajectory of a water stream being thrown by nozzle 6 as will be described in more detail hereafter.

Figure 5:
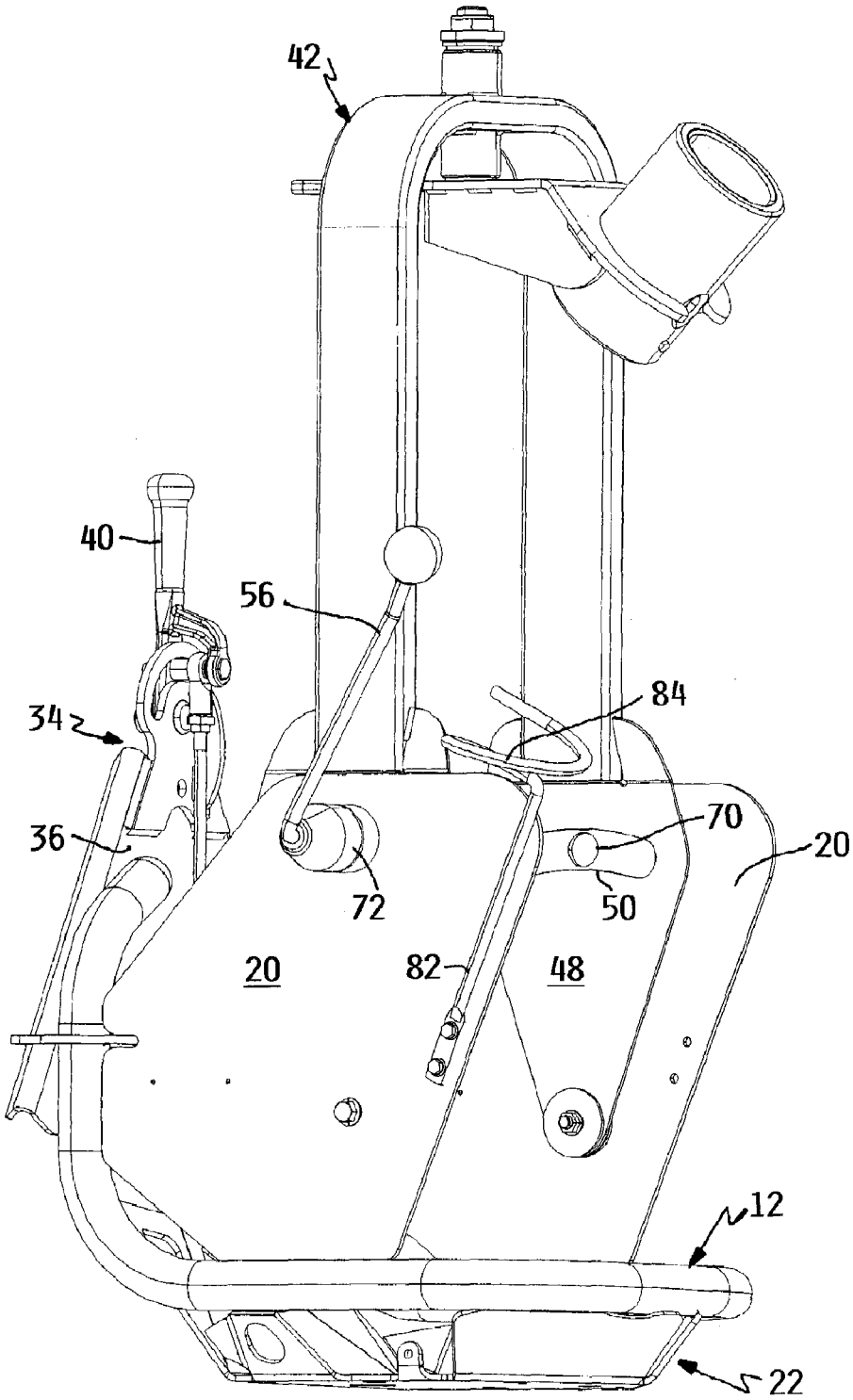
FIG. 5 is a perspective view of the frame of the pump assembly as depicted in FIG. 2, but taken from ahead of and towards the right of the pump assembly and particularly illustrating the rotatable handle used to engage and disengage the friction clutch that locks or secures the trajectory adjustment of the nozzle.
Figure 6:
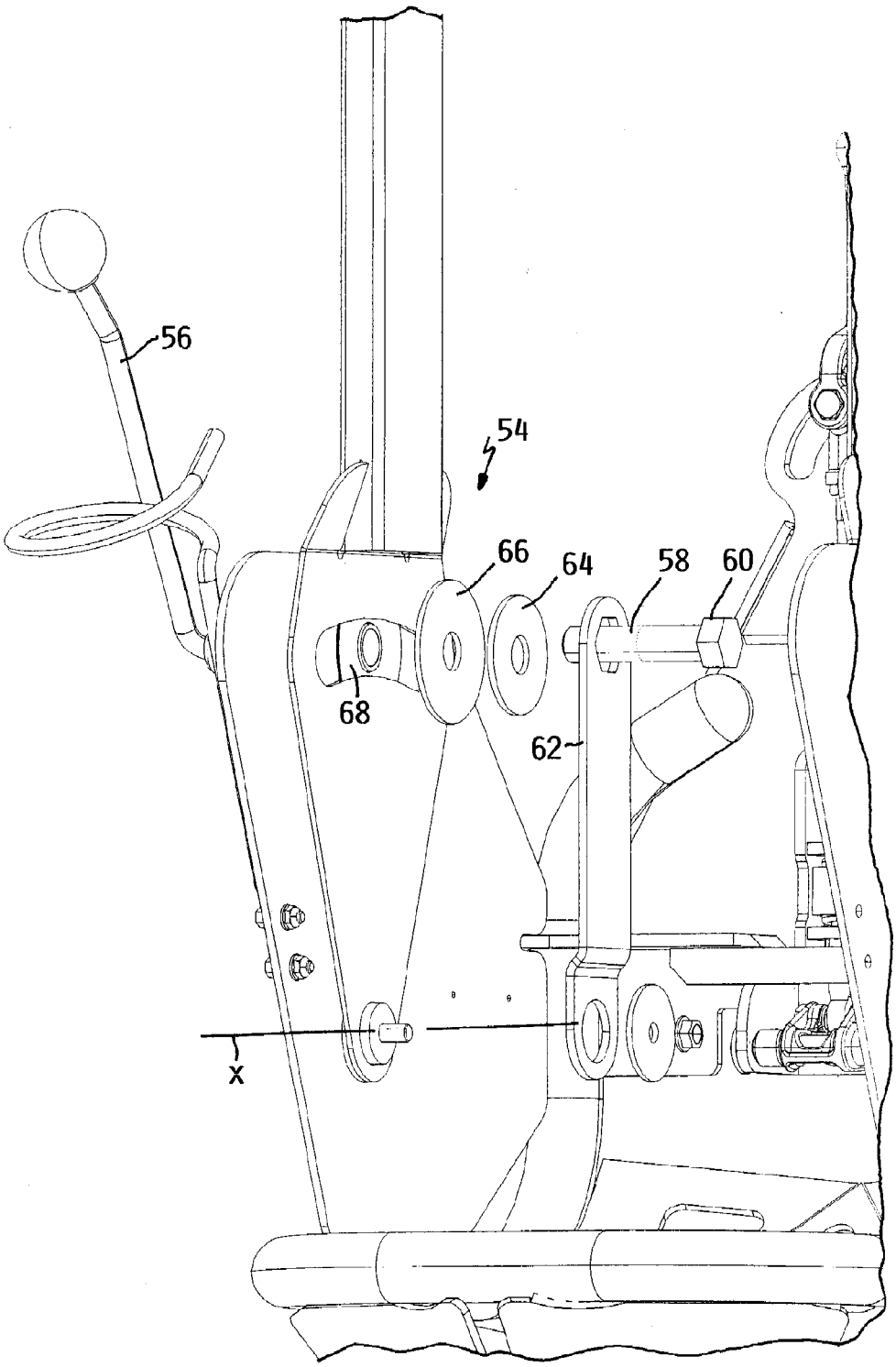
FIG. 6 is an enlarged, exploded perspective view of various components of the friction clutch used to lock or secure the trajectory adjustment of the nozzle.
Figure 7:
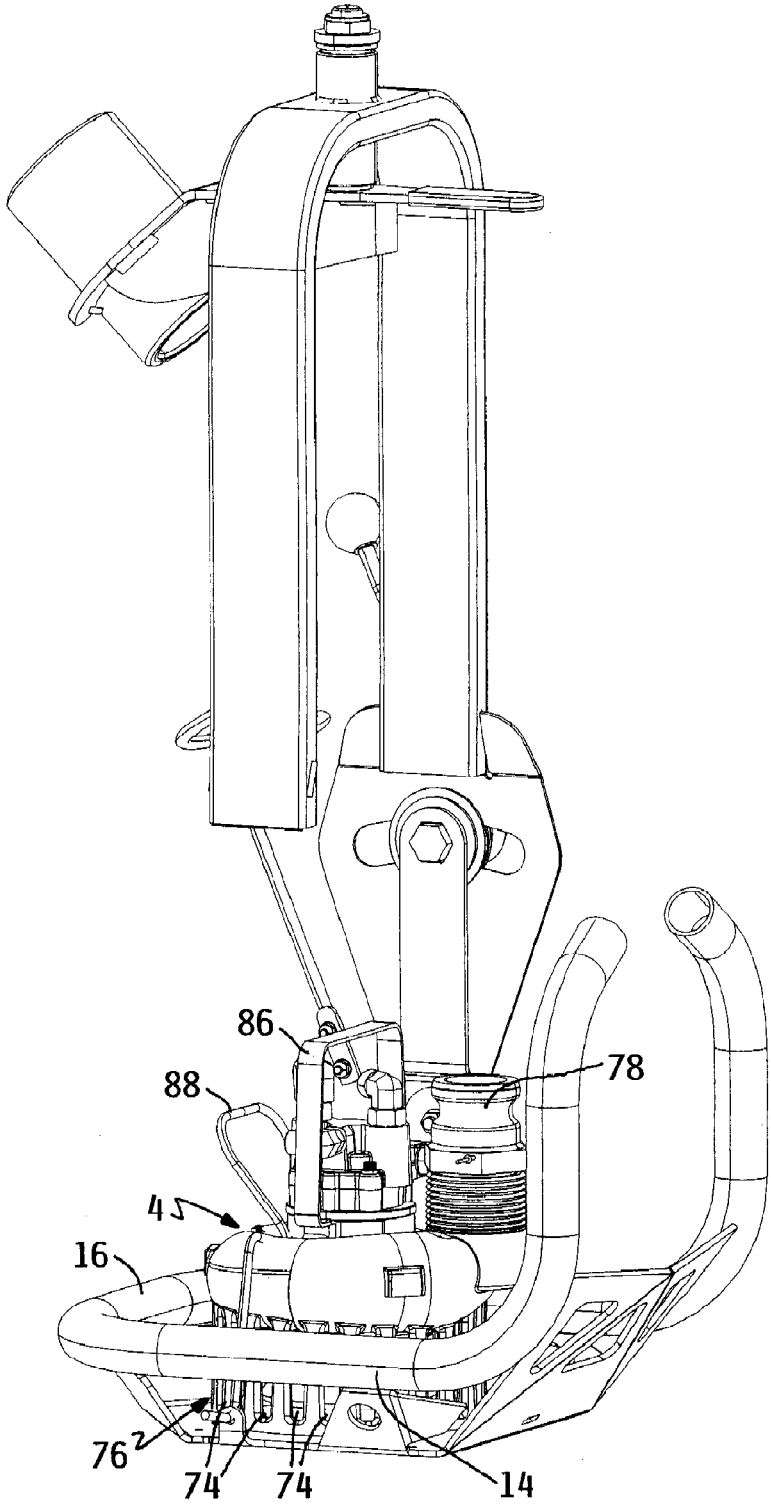
FIG. 7 is a perspective view of the pump assembly of FIG. 1, but with portions of the frame having been removed to more clearly illustrate the placement of the water pump within the bottom bowl of the frame and showing the water outlet of the water pump at the rear of the water pump.

Each side of arch 42 carries an arcuate, substantially horizontal slot 50 in each flange 48. Slots 50 are best shown in FIG. 4. Referring now to FIGS. 5 and 6, a friction clutch 54 is positioned to act between one flange 48 and frame 10. Friction clutch 54 can be tightened or loosened by pivoting an operating handle 56 back and forth as depicted by the arrows A and B in FIGS. 5 and 6. When friction clutch 54 is tightened, arch 42 is clamped in place relative to side plates 20 to hold the trajectory of the water stream in an adjusted position. When operating handle 56 is pivoted to loosen friction clutch 54, arch 42 can be pivoted between side plates 20 at least over the length of arcuate slot 50. Arch 42 can be pivoted after friction clutch 54 is released simply by the user placing his hand against arch 42 and by pushing or pulling on arch 42 in a fore and aft direction.

Referring now to FIG. 6, a pivot pin formed by the smooth shank 58 of a bolt 60 end passes through the upper end of a pivotal link 62 that is pivotally journalled on the same axis of rotation x about which arch 42 pivots. Bolt 60 then passes through a washer 64, through a first friction disc 66 carried on one side of flange 48, through a second friction disc 68 carried on the other side of flange 48 between flange 48 and side plate 20, and then out through a circular hole 70 carried in side plate 20 (like hole 70 shown in the other side plate 20). The outer end of bolt 60 is then threaded into a rotatable hub 72 which carries operating handle 56. When handle 56 is pivoted in one direction, bolt 60 is drawn inwardly towards hub 72 to compress the various friction discs 66, 68 towards one another and cause friction clutch 54 to become tightened and engage. When handle 56 is pivoted in the other direction, bolt 60 is slid away from hub 72 to loosen friction discs 66, 68 and to break the clamping force provided by friction clutch 54.

While other types of securing or locking means could be used for holding arch 42 in place on frame 10, friction clutch 54 operated by a simple pivotal handle 56 on one side of frame 10 is an inexpensive and durable mechanism for accomplishing the locking action.

The Easily Installed Water Pump

Pump 4 used as part of pump assembly 2 is a generally conventional centrifugal water pump of known design. Pump 4 contains a plurality of vertically extending water inlet slots 74. The open area of slots 74 collectively define a water inlet 76 to pump 4. Inside pump 4, a rotatable vane or impeller is rotated by the operation of a hydraulic or similar motor to draw water into pump 4 through inlet 76. This water is then ejected from pump 4 through an integrally formed and vertically extending pump outlet 78.

In order to power pump 4, the pump 4 has a plurality of connections 80 for hydraulic hoses (not shown) that lead back to the hydraulic system on the vehicle. There are typically three such hoses. One hose supplies pressurized fluid to the motor of pump 4, another hose carries return fluid from the motor of pump 4 back to the hydraulic system of the vehicle, and a third hose is a drain hose for draining the motor of pump 4 of hydraulic fluid. One side plate 20 of frame 10 carries a rod 82 having an encircling upper end 84 disposed in a slight helix. Upper end 84 of rod 82 forms a hose management device for keeping the hydraulic hoses bundled together and for passing them through the upper end of rod 82 as the hoses extend between the vehicle and pump 4. While useful, rod 82 could be deleted if so desired.

Figure 11:
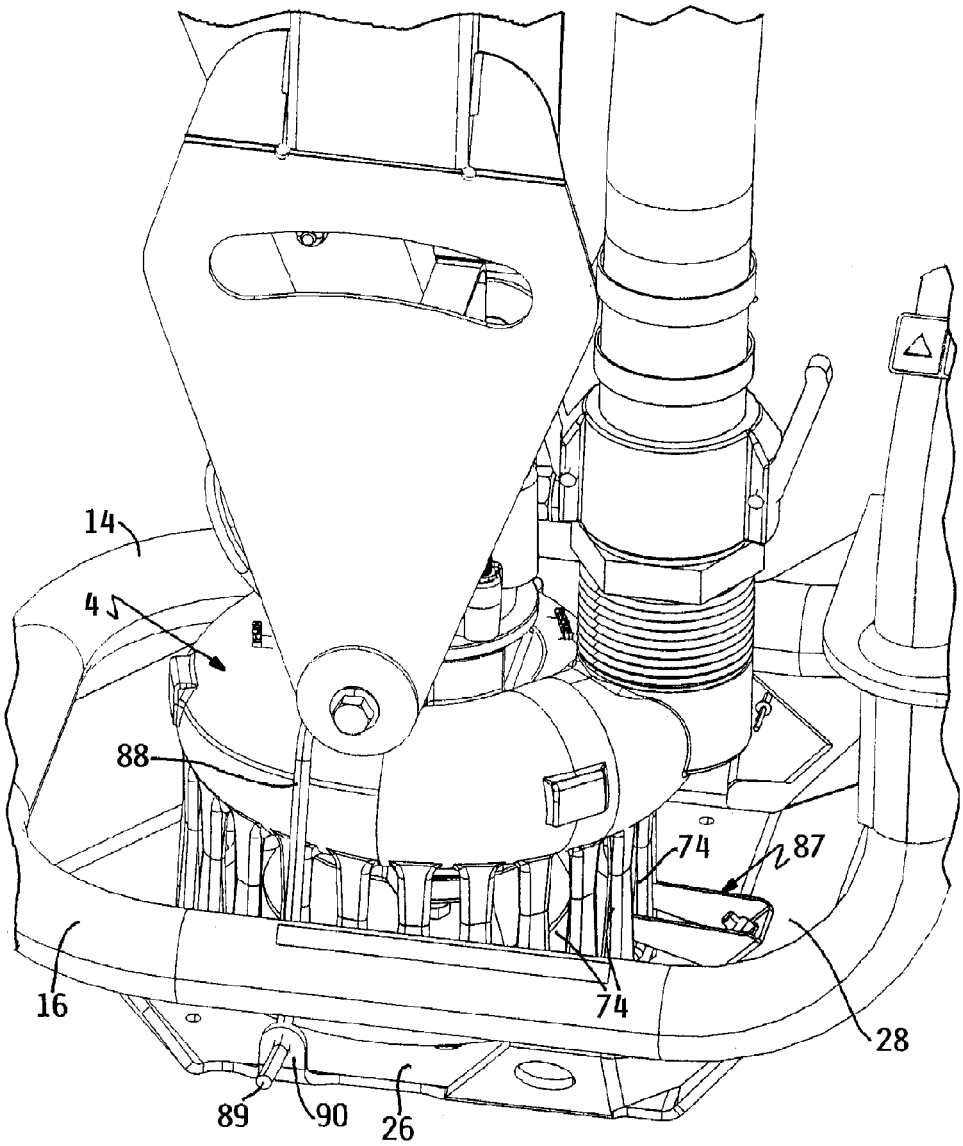
FIG. 11 is a perspective view of a portion of the pump assembly of FIG. 1 having one of the side plates of the frame removed to illustrate the rear wall of the bottom bowl of the frame to more particularly show a pronged, U-shaped keeper that holds the rear of the pump down onto the floor of the bowl.

Pump 4 is designed to be easily and quickly installed in frame 10 of pump assembly 2. In this regard, pump 4 has an integral strap or carry handle 86 for allowing pump 4 to be lifted and lowered and to be carried. To install pump 4, the user or operator of pump assembly 2 can grab handle 86 on pump 4 and move pump 4 over bowl 22 of frame 10. Then, the user or operator can lower pump 4 until pump 4 engages against floor 26 of bowl 22 in a desired location. The bottom of pump 4 and floor 26 of bowl 22 can have locating detents (not shown) into which pump 4 drops when it is in the correct position. However, as shown in FIG. 11, there is a pronged, U-shaped keeper 87 on rear wall 28 of bowl 22. The two forwardly extending prongs of keeper 87 slip into two of the water inlet slots 74 on pump 4 to restrain vertical movement of pump 4 and help hold the rear of pump 4 down against floor 26 of bowl 22.

After so placing pump 4 in bowl 22 while being cognizant of the need to also move pump 4 to engage keeper 87 within a pair of slots 74, the user can then grab a pivotal wire form 88 that is provided on floor 26 of bowl 22 and rotate wire form 88 up and over the front of pump 4. Wire form 88 is shaped to snap over a portion of pump 4 as it is rotated by the user or operator into a generally upright orientation as shown in FIG. 1. Wire form 88 in combination with keeper 87 simply clamps pump 4 against floor 26 of bowl 22 without using or requiring any other fasteners. The outturned ends 89 of the legs of wire form 88 are pivotally received in apertured tabs 90 on each side of floor 26 of bowl 22. This is how wire form 88 is pivotally journalled on bowl 22.

Obviously, the use of wire form 88 allows pump 4 to be quickly and easily installed in frame 10 of pump assembly 2. To install, all the user need do is to pivot wire form 88 until it snaps in place against the top of pump 4. To remove pump 4, all the user need do is to pivot wire form 88 in the opposite direction until wire form 88 releases the top of pump 4 and moves forwardly in front of pump 4. Pump 4 can then simply be lifted out of bowl 22 after first sliding pump 4 forwardly slightly to disengage keeper 87 from slots 74.

In addition, once pump 4 is installed in bowl 22 on frame 10, it is largely and substantially protected on all sides by both bowl 22 of frame 10 as well as by the rounded tubular form of U-shaped foot 12. This protects pump 4 from damage should the operator of the vehicle inadvertently drive or back the vehicle in a way that would otherwise cause pump 4 to impact against some obstacle. If this happens, foot 12 or bowl 22 or both take the impact, but pump 4 does not take the impact. Accordingly, there will be fewer ways in which pump 4 can be damaged. Moreover, if pump 4 does need to be serviced or replaced, it is easy to remove pump 4 from frame 10 for such service or replacement.

The Nozzle and Connecting Conduit

Figure 8:
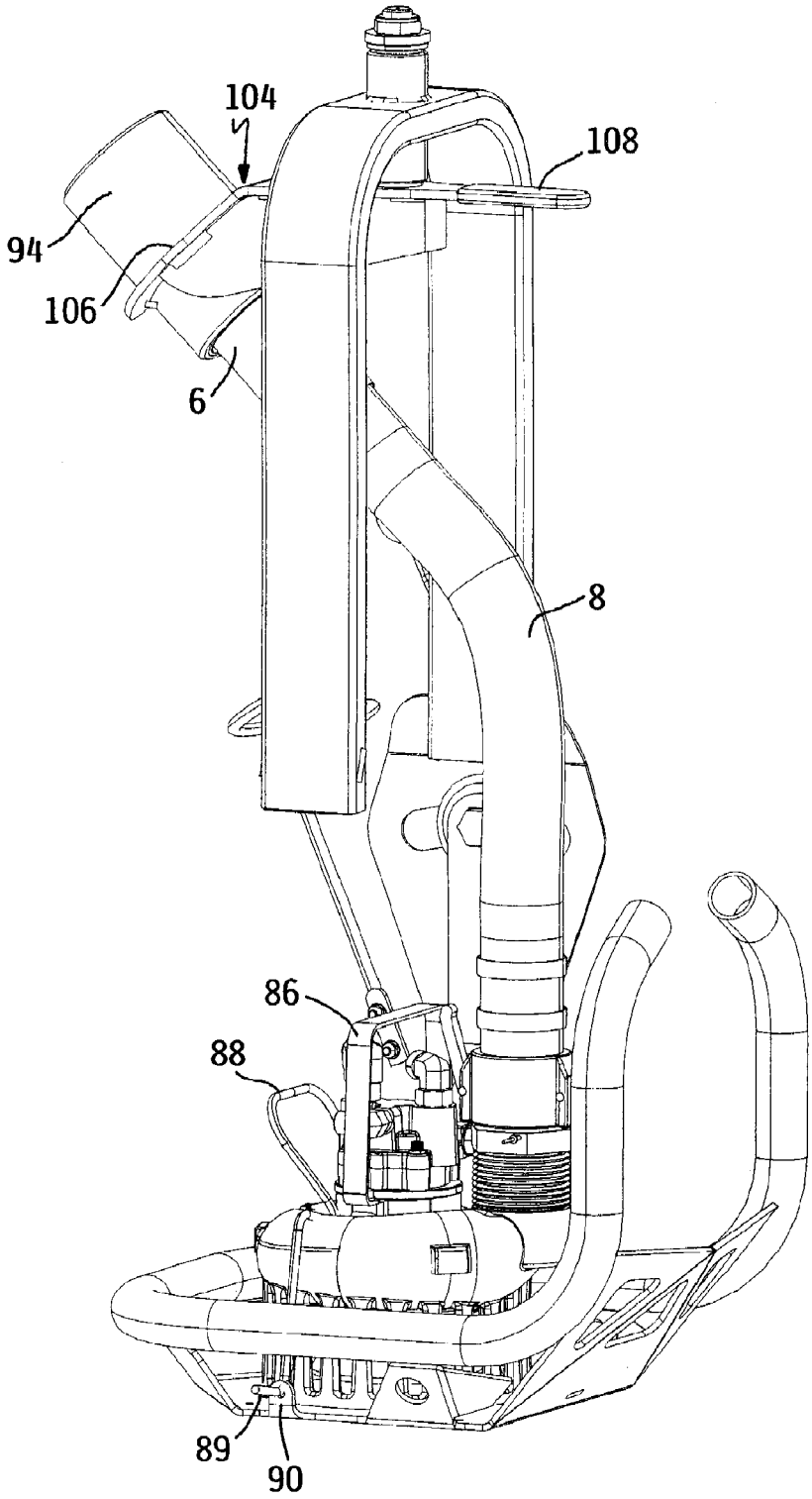
FIG. 8 is a perspective view similar to FIG. 7, but showing the flexible conduit in place connecting the outlet of the water pump to the water discharge nozzle.
Figure 9:
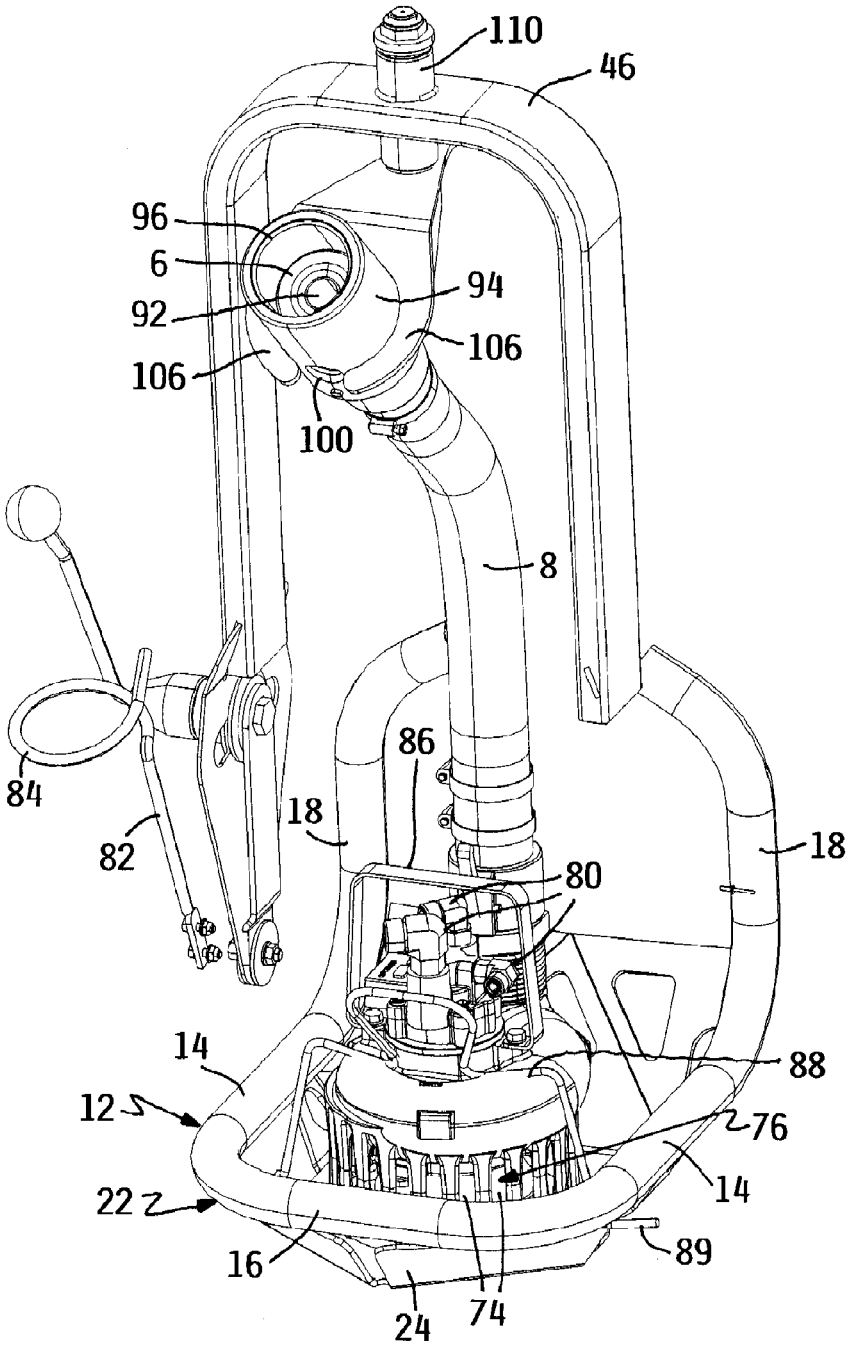
FIG. 9 is a perspective view of the components shown in FIG. 8, but taken from in front of the pump assembly and particularly illustrating the water discharge nozzle received inside an upper nozzle support sleeve that acts on the discharge nozzle to bend and rotate or twist the flexible conduit to make trajectory and direction adjustments in the water stream being thrown by the nozzle.
Figure 10:
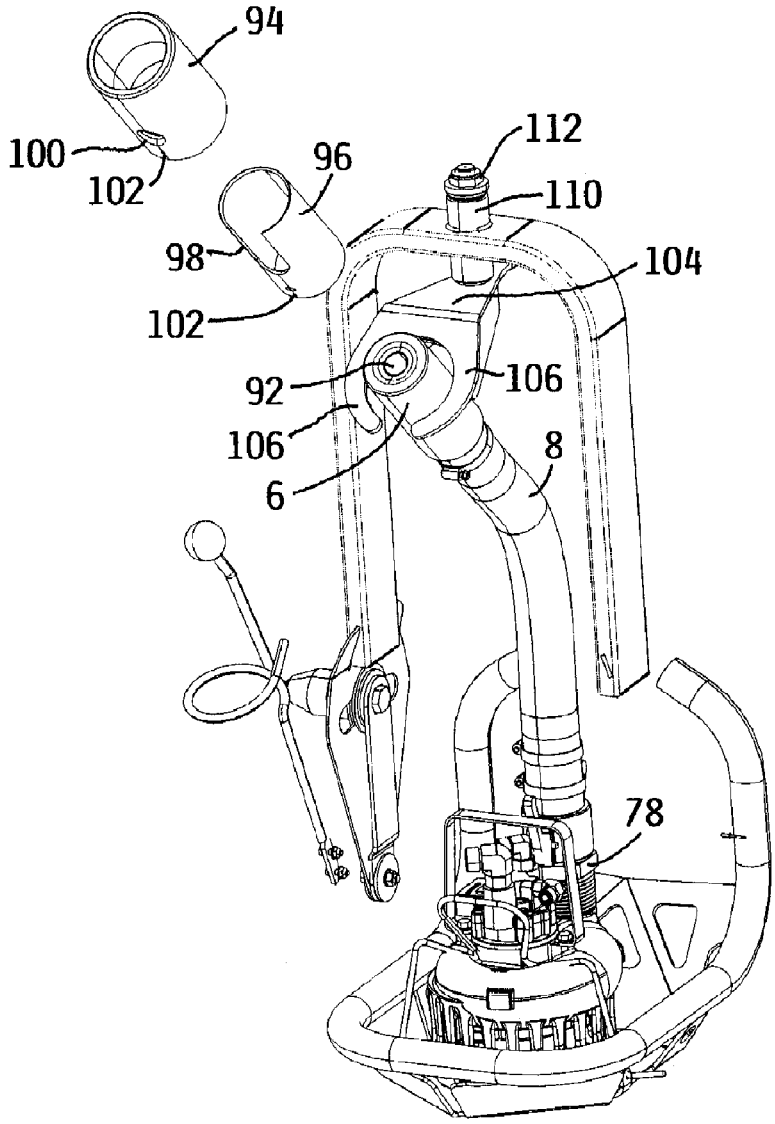
FIG. 10 is a perspective view similar to FIG. 9, but showing the nozzle support sleeve and an intermediate bearing having been exploded off of the water discharge nozzle for better illustrating a sand and grit drain path provided in the nozzle support sleeve and intermediate bearing.

Referring now to FIGS. 8-10, an elongated flexible hose or conduit 8 is used to connect pump outlet 78 to nozzle 6 carried at the top of pivotal arch 42. As shown in FIG. 8, the bottom of conduit 8 is clamped by hose clamps to the upwardly extending outlet 78 of pump 4. As shown in FIG. 10, the top of conduit 8 is similarly clamped by a hose clamp to the bottom of a cylindrical nozzle 6 having a lower nipple or stem (not shown) that is telescopically received inside conduit 8 with conduit 8 being clamped around this nipple or stem. Nozzle 6 includes a continuously open nozzle outlet 92 for projecting a water stream from pump assembly 2. This water stream is basically the water being pumped by pump 4 into conduit 8 with conduit 8 then feeding nozzle 6.

As also shown in FIGS. 8-10, an upper nozzle support sleeve 94 and an intermediate bearing sleeve 96 are used to hold nozzle 6 at the top of arch 42 generally in front of and slightly under cross beam 46 of arch 42. Nozzle support sleeve 94 may be made of metal while bearing sleeve 96 may be made of a low friction material, such as plastic. Bearing sleeve 96 has an elongated slot 98 extending along its lower surface for much of the length of bearing sleeve 96. Nozzle support sleeve 94 has a hole 100 in its lower surface. Nozzle support sleeve 94 and bearing sleeve 96 are desirably joined together by a screw (not shown) that passes through holes 102 that are aligned when bearing sleeve 96 is telescopically inserted into nozzle support sleeve 94. When so joined together, hole 100 in the lower surface of nozzle support sleeve 94 will register or overlie the lower end of slot 98 in bearing sleeve 96.

Figure 12:
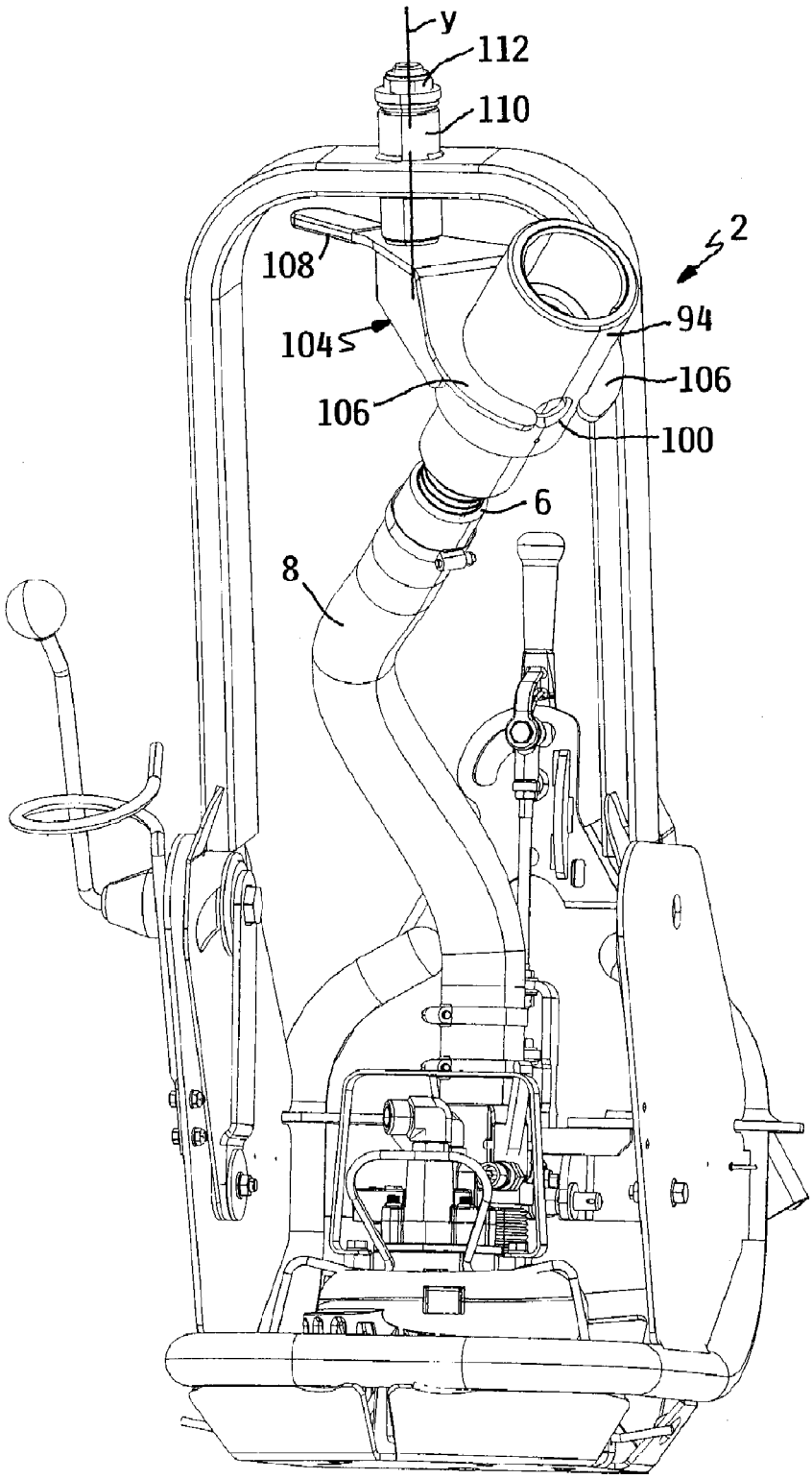
FIG. 12 is a perspective view similar to FIG. 1 of the pump assembly shown in FIG. 1, but illustrating the water discharge nozzle having been adjusted to throw water along a second trajectory lower than the first trajectory of FIG. 1 and in a second direction that is rotated more towards the right of the frame as compared to the first direction shown in FIG. 1.

A pivotal yoke 104 s carried on the underside of cross beam 46 of arch 42. Yoke 104 includes a pair of spaced, curved legs 106 that surround and engage against the outer diameter of nozzle support sleeve 94. It is yoke 104 that applies force to nozzle support sleeve 94, and thus to nozzle 6 and conduit 8, when arch 42 is pushed or pulled about the axis of rotation x to push or pull nozzle 6 forwardly or rearwardly to change the angle of trajectory of the water stream. The angle of trajectory is changed by flexing or twisting conduit 8 in a fore and aft direction as permitted by the flexible nature of conduit 8. For example, when arch 42 is pivoted into a more upright orientation on frame 10 to provide a higher trajectory of throw, conduit 8 is more vertically oriented with nozzle 6 maintained at a higher angle. When arch 42 is pivoted forwardly into a less upright orientation as shown in FIG. 12, conduit 8 bends forwardly to dispose nozzle 6 at a shallower angle relative to the horizontal, thus reducing the trajectory of throw. This has been shown in FIG. 12 in which arch 42 has been pivoted somewhat more forwardly on frame 10 than what is shown in FIGS. 1-10.

In addition, to bending conduit 8 in a fore and aft direction to change the angle of trajectory, yoke 104 can be selectively pivoted from side to side to change the direction in which the water stream is being thrown. To this end, yoke 104 has a rearwardly extending handle 108 which can be gripped by the operator to pivot yoke 104 about a substantially vertical pivot axis indicated as y in FIG. 12. An adjustable frictional retaining device 110 extends between cross beam 46 of arch 42 and yoke 104 to provide a desired amount of friction on yoke 104 to hold yoke 104 in a pivotally adjusted position. The amount of the frictional retaining force provided by device 110 can be adjusted by rotating a top adjustment nut 112 to increase or decrease the friction provided by one or more friction discs (not shown) provided inside device 110. The amount of friction is selected to be strong enough to hold yoke 104 in place under the force of the water stream exiting through nozzle 6, but not so strong that it cannot be overcome by hand by the user simply gripping handle 108 and manually turning yoke 104 to one side or the other. As also shown in FIG. 12, when yoke 104 is turned to the side, the motion of yoke 104 is accommodated by a twisting and flexing of conduit 8 in a lateral direction.

Operation

The mounting of pump assembly 2 of this invention on a vehicle, such as a Sand Pro, has been previously described in the Introduction section of this Detailed Description. The use of the vehicle to position pump assembly 2 in a water filled depression, such as a sand trap or bunker on the golf course, was also previously described. However, a few additional comments regarding the operation of pump assembly 2 are in order.

Both the angle of trajectory of the water throw as well as the lateral direction of the water throw are simply and easily adjusted, the former by releasing friction clutch 54 holding arch 42 in place and by then pushing or pulling on arch 42 and the latter simply by swinging yoke 104 from side to side until nozzle 6 points in a desired direction. All of this is accommodated simply by the flexing of conduit 8 in a fore and aft direction or in a side to side direction. Thus, there is no need for numerous pivot joints in nozzle 6 structure and the need to seal such joints against linkage. All the user need do is to make sure the ends of conduit 8 are tightly clamped to pump outlet 78 and the inlet of nozzle 6 using simple hose clamps. This mounting of nozzle 6 and the use of flexible conduit 8 comprises a simple and durable water throw adjustment mechanism.

As nozzle 6 is adjusted up and down and from side to side, it is continuously telescopically received within nozzle support sleeve 94 and bearing sleeve 96, but can slide back and forth within these two sleeves as need be to accommodate the changes in geometry of conduit 8 as conduit 8 flexes. Thus, in some cases, nozzle 6 will be retracted well within nozzle support sleeve 94 and in other cases nozzle 6 will be less retracted within nozzle support sleeve 94. However, at no time will nozzle 6 leave or be completely withdrawn from nozzle support sleeve 94. If desired, a physical stop can be used to prevent such complete disengagement.

Moreover, as pump assembly 2 begins to reach the lowermost portions of the water in the water filled depression, the amount of water being pumped will decrease and the water stream will often relatively become more laden with sand or grit from the bottom of the depression. This sand or grit laden water stream will tend to dribble out of nozzle 6 as the volume of the water stream drops off and the water stream loses coherence. This reduced dribble of a water stream will fall down onto the inner diameter of bearing sleeve 96 and tend to flow rearwardly and downwardly on the inner diameter of bearing sleeve 96 into the small gap between the inner diameter of bearing sleeve 96 and the outer diameter of nozzle 6. The Applicants discovered that this sand or grit could wedge or be caught in this gap, thus preventing the free sliding movement of nozzle 6 within bearing sleeve 96 and nozzle support sleeve 94. In effect, nozzle 6 could bind up within sleeves 94, 96 and become difficult or impossible to adjust.

This problem is solved in this invention by the elongated slot 98 placed in the lower surface of bearing sleeve 96 and the hole 100 in nozzle support sleeve 94 that registers with the lower end of slot 98. Now, if a small water flow containing sand or grit flows back down the inner diameter of bearing sleeve 96, it first passes into slot 98 and then falls or drains out of hole 100 in nozzle support sleeve 94. The sand or grit is thus prevented from reaching and becoming jammed in the sliding interface between nozzle 6 and bearing sleeve 96. This helps ensure that nozzle 6 will not bind up and will remain freely adjustable.

The protective advantages of mounting pump 4 within the U-shaped foot 12 of frame 10 and down within bowl 22 beneath foot 12 have been earlier described herein, as have the ease of installation and removal of pump 4 due to the use of pivotal wire form 88.

The ease in which pump 4 can be installed and removed from bowl 22 leads to a method of operation in which pump 4 can be removed from bowl 22 and used remotely from frame 10. This might be required when, for example, the vehicle to which frame 10 is attached cannot drive or back far enough down into the water filled depression that is to be pumped out.

In this case, it is easy for a user to rotate wire form 88 forwardly to disengage pump 4 and to then remove pump 4 from bowl 22 by sliding pump 4 forwardly to disengage keeper 87 and by then lifting up on pump 4. A set of extensions for the hydraulic hoses (e.g. 10 or 20 foot extensions or the like) that connect pump 4 to the hydraulic system on the vehicle could be supplied and used by the user to extend the length of the hose runs to allow pump 4 to be positioned some distance away from the vehicle. In allowing this remote use of pump 4, it is also necessary for the user to disconnect pump outlet 78 from the bottom of conduit 8 by loosening the hose clamps and by lifting the bottom of conduit 8 up off of outlet 78. The user will then need to clamp a simple second flexible conduit of some type to pump outlet 78 with this conduit having a relatively long length, e.g. 10 or 20 feet or more.

With pump 4 disconnected from bowl 22, and with the hose extensions in place to extend how far away pump 4 can be positioned from the vehicle, the user can then walk the pump to some location in the water filled depression that can't be reached by the vehicle. The user can then simply lower pump 4 into contact with the bottom of the depression and with the pump either partially or fully submerged in the water. After placing pump 4 in this manner, the user will then grab the longer second flexible conduit that has been clamped to pump outlet and walk this conduit out of depression 4 until the free end of the conduit is over the ground, e.g. until the free end of the conduit has reached the bank or shore adjacent the depression. The user then simply drops the free end of the conduit down onto the ground. If the vehicle engine is then started and the vehicle hydraulic system put into operation, pump 4 will still operate to pump water out of the depression and through the conduit onto the ground, even though pump 4 in this orientation is only connected to the vehicle in an umbilical manner through the hydraulic hoses whose length has been extended using hose extensions. Thus, pump 4 of this invention can be operated in various diverse ways to increase the value of water pump assembly 2 to the user.

Various modifications of this invention will be apparent to those skilled in the art. Thus, the scope of the invention shall be limited only by the appended claims.

We claim:

1. A water pump assembly adapted to be installed on a vehicle for pumping water out of water filled depressions in the ground, which comprises:

(a) a frame having a mount for mounting the frame to the vehicle;

(b) a water pump mounted on the frame and surrounded by an encircling U-shaped foot on the frame to protect the water pump from damage from impacts with obstacles;

(c) a pivotal member carried on the frame for pivoting motion about a substantially horizontal pivot axis;

(d) a water discharge nozzle carried on the pivotal member; and (e) a flexible conduit connecting the water discharge nozzle on the pivotal member to an outlet of the water pump on the frame, wherein pivoting of the pivotal member on the frame about the substantially horizontal pivot axis flexes the conduit in a fore and aft direction to raise or lower the trajectory of the water stream being thrown from the nozzle.

2. The water pump assembly of claim 1, wherein the nozzle is further pivotal about a vertical pivot axis on the pivotal member to laterally change the direction of throw of the water stream by further flexing or twisting the conduit in a side to side manner.

3. The water pump assembly of claim 2, wherein the nozzle is carried on the pivotal member by being telescopically inserted into a nozzle support sleeve in which the nozzle is free to slide back and forth to accommodate flexural changes in the conduit.

4. The water pump assembly of claim 3, wherein the nozzle support sleeve is held within a U-shaped yoke that is pivotally mounted on the pivotal member such that the yoke pivots back and forth about the vertical pivot axis.

5. The water pump assembly of claim 4, further including a frictional retaining device on the pivotal member acting against the yoke for frictionally holding the yoke in a pivotally adjusted position about the vertical pivot axis, wherein the frictional retaining force can be overcome by the user manually rotating the yoke against the frictional retaining force.

6. The water pump assembly of claim 1, further including a manually engageable holding device for locking the pivotal member in a pivotally adjusted position.

7. The water pump assembly of claim 6, wherein the holding device is a manually engageable and releasable clutch acting between the pivotal member and the frame.

8. The water pump assembly of claim 1, wherein the pivotal member comprises an arch having an upper cross beam and vertical sides depending downwardly from the cross beam, and wherein the nozzle is carried on the cross beam of the arch.

9. A water pump assembly adapted to be installed on a vehicle for pumping water out of water filled depressions in the ground, which comprises:

(a) a frame having a mount for mounting the frame to the vehicle;

(b) a water pump mounted on the frame;

(c) a pivotal member carried on the frame for pivoting motion about a substantially horizontal pivot axis;

(d) a water discharge nozzle carried on the pivotal member with the nozzle receiving water being pumped by the pump for throwing the water being pumped by the pump in a water stream along a trajectory relative to horizontal, wherein the trajectory of the water stream being thrown by the nozzle is adjustable by pivoting of the pivotal member on the frame about the substantially horizontal pivot axis; and (e) a nozzle support sleeve for mounting the nozzle on the pivotal member, the nozzle being telescopically received inside the nozzle support sleeve and being slidable back and forth within the nozzle support sleeve as the trajectory of the water stream is adjusted by pivoting of the pivotal member.

10. The water pump assembly of claim 9, wherein the nozzle support sleeve includes a drain opening in an underside of the nozzle support sleeve such that any water flowing downwardly between the nozzle and the nozzle support sleeve will reach and drain through the drain opening to avoid any grit or sand particles carried in the downwardly flowing water from collecting between the nozzle and the nozzle support sleeve.

11. The water pump assembly of claim 10, further including an intermediate bearing sleeve interposed between the nozzle support sleeve and the nozzle with the bearing sleeve being fixed to the nozzle support sleeve.

12. The water pump assembly of claim 11, wherein the bearing sleeve is made of a low friction material.

13. The water pump assembly of claim 11, wherein the bearing sleeve includes an elongated slot on an underside of the bearing sleeve with a lower end of the slot registering with the drain opening in the nozzle support sleeve such that the downwardly flowing water passes into and down towards the lower end of the slot in the bearing sleeve and then downwardly through the drain opening to drain away from the nozzle.

14. The water pump assembly of claim 9, wherein the nozzle is also adjustable on the pivotal member by pivoting the nozzle about a substantially vertical pivot axis to further adjust a side-to-side direction in which the water stream is thrown.

15. The water pump assembly of claim 14, further including a frictional holding device for retaining the nozzle in a pivotally adjusted position about the vertical axis with a force that can be overcome by a user manually gripping and pivoting the nozzle about the vertical axis.

16. The water pump assembly of claim 9, further including a flexible conduit connecting the nozzle to a water outlet on the pump.

17. A water pump assembly adapted to be installed on a vehicle for pumping water out of water filled depressions in the ground, which comprises:

(a) a frame having a mount for mounting the frame to the vehicle;

(b) a water pump mounted on the frame;

(c) a pivotal member carried on the frame for pivoting motion about a substantially horizontal pivot axis;

(d) a water discharge nozzle carried on the pivotal member;

(e) a flexible conduit connecting the water discharge nozzle on the pivotal member to an outlet of the water pump on the frame, wherein pivoting of the pivotal member on the frame about the substantially horizontal pivot axis flexes the conduit in a fore and aft direction to raise or lower the trajectory of the water stream being thrown from the nozzle; and (f) wherein the pump mounts on the frame using:

(i) a keeper that engages the pump and restrains vertical movement of one side of the pump when the pump is abutted against a floor of the frame and the pump has been moved to engage the one side of the pump against the keeper; and (ii) a pivotal wire form that pivots over an opposite side of the pump and engages against a portion of the pump to clamp the opposite side of the pump against the floor of the frame, the wire form being manually pivotal between a first clamping position in which the wire form overlies the opposite side of the pump and a second non-clamping position in which the wire form is clear of the opposite side of the pump to allow the pump to be quickly and easily installed on or removed from the floor the frame.

18. The water pump assembly of claim 17, wherein the pump is hydraulically driven from a hydraulic system carried on the vehicle with hydraulic fluid being supplied to and returned from the pump by a first set of hydraulic hoses extending between the hydraulic system on the vehicle and the pump when the pump is mounted on the frame and the frame is attached to the vehicle, and further including a second set of extension hydraulic hoses that may be used in addition to the first set of hydraulic hoses to allow the pump to be disconnected from the floor of the frame and to be placed in the water filled depression at a location that is remote from both the frame and the vehicle.

19. The water pump assembly of claim 18, wherein the pump when used in the remote location is disconnected from the conduit and nozzle on the frame, and further including a second flexible conduit connected to a water outlet of the pump when the pump is used in the remote location with the second conduit being longer than the conduit connecting the pump to the nozzle with the second conduit extending from the remote location to a location on the ground outside of the water filled depression.

20. The water pump assembly of claim 17, wherein the keeper is U-shaped and has two parallel, spaced prongs that are inserted into a pair of vertical water inlet slots in the pump.

* * * * *